US006752511B1

(12) United States Patent
Cramer

(10) Patent No.: US 6,752,511 B1
(45) Date of Patent: Jun. 22, 2004

(54) MINIATURE HAT LIGHT

(75) Inventor: David Cramer, Glendale, AZ (US)

(73) Assignee: Headlite LLC, Scottsdale, AZ (US)

( * ) Notice: Subject to any disclaimer, the term of this patent is extended or adjusted under 35 U.S.C. 154(b) by 0 days.

(21) Appl. No.: 10/413,639

(22) Filed: Apr. 15, 2003

(51) Int. Cl.[7] ..... F21V 21/084
(52) U.S. Cl. ..... 362/106; 362/105
(58) Field of Search ..... 362/105, 106, 362/190, 191, 208; 2/209.13, 422, 906

(56) References Cited

U.S. PATENT DOCUMENTS 1,109,415 A * 9/1914 Harris ..... 362/106
4,827,384 A * 5/1989 Von Schlemmer ..... 362/106
5,894,604 A * 4/1999 Crabb et al. ..... 2/209.13
2001/0024365 A1 * 9/2001 Aknine ..... 362/106

* cited by examiner

*Primary Examiner*—Y My Quach Lee
(74) *Attorney, Agent, or Firm*—Parsons&Goltry; Robert A Parsons; Michael W. Goltry

(57) ABSTRACT

A hat light includes an elongated body with integral stabilizers extending laterally outwardly and positioned to engage the head of the wearer to substantially reduce rotary movement. The body is positioned within the hat with one end adjacent the hole. A hat engaging member is constructed to extend through the hole in the hat and engage the elongated body so as to fixedly grip the front portion of the hat to hold the elongated body oriented in an upward and backward direction within the hat. A light emitting diode is mounted in the elongated body and positioned to direct light in a forward direction from the front portion of the hat.

17 Claims, 5 Drawing Sheets

MINIATURE HAT LIGHT

FIELD OF THE INVENTION

This invention relates to convenience lights and more specifically to lighting devices carried by a hat for hands-free operation.

BACKGROUND OF THE INVENTION

In many instances of day-to-day living it is desirable to have a hands-free lighting device available for supplying and directing light onto a work area, play area, etc. One very popular piece of apparel for carrying such a lighting device is a hat. By placing a light source in a hat, the light is always direct approximately in the direction that the user is looking.

Early miners wore gas lights in their hats to provide light during mining operations. These devices were inconvenient and dangerous but essentially the only thing available at the time. Late hat lights have been developed that are electrical and operate from batteries. These lights are more convenient but in many instances are so large that they tend to obstruct or hamper movement. Some attempts have been made to place the lights inside the hats but these devices are generally uncomfortable and have a tendency to move around and direct the light in the wrong direction.

It would be highly advantageous, therefore, to remedy the foregoing and other deficiencies inherent in the prior art.

Accordingly, it is an object of the present invention to provide a new and improved lighting device for hats and the like.

Another object of the invention is to provide a new and improved lighting device for hats and the like that provides substantially brighter light.

And another object of the invention is to provide a new and improved lighting device for hats and the like that fits more comfortably in a hat and remains directed in a desired direction.

Still another object of the invention is to provide a new and improved lighting device for hats and the like that is lighter and more convenient to wear and operate.

Still another object of the present invention is to provide a new and improved lighting device for hats and the like that is simpler and less expensive to manufacture.

SUMMARY OF THE INVENTION

The above problems and others are at least partially solved and the above purposes and others realized in a new and improved hat light including an elongated body with stabilizers extending laterally outwardly to substantially reduce rotary movement. The stabilizers may be, for example, integral ears positioned to lie against the head of a wearer. The body is positioned within the hat with one end adjacent a hole through the hat. A hat engaging member is constructed to extend through the hole in the hat and engage the elongated body so as to fixedly grip the front portion of the hat to hold the elongated body member oriented in an upward and backward direction within the hat. A light emitting diode (LED) is mounted in the elongated body and positioned to direct light in a forward direction from the front portion of the hat. Generally, a lens is associated with the LED to focus the light in the desired direction.

BRIEF DESCRIPTION OF THE DRAWINGS

The foregoing and further and more specific objects and advantages of the invention will become readily apparent to those skilled in the art from the following detailed description taken in conjunction with the drawings in which.

DETAILED DESCRIPTION OF A PREFERRED EMBODIMENT

Figure 1:
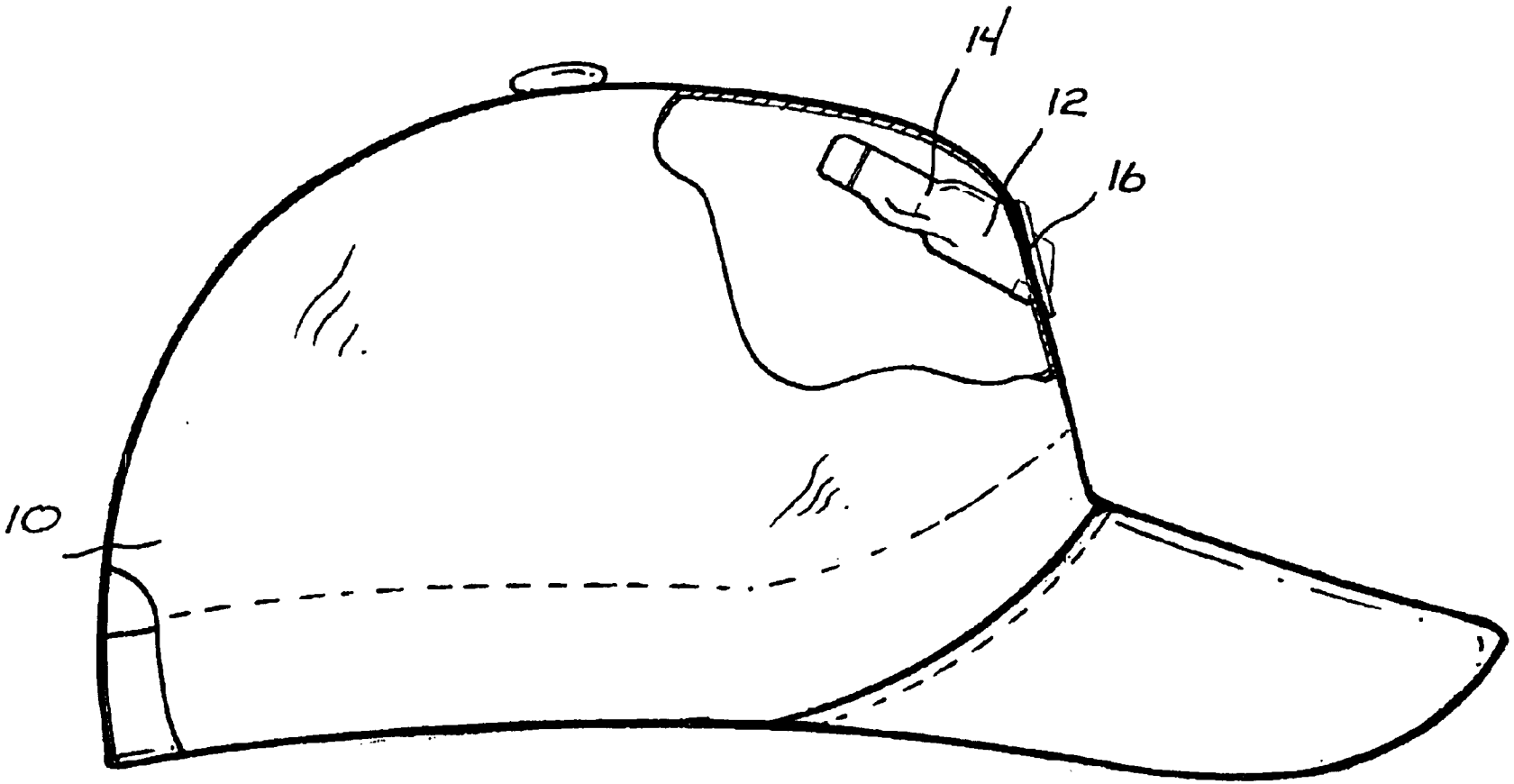
FIG. 1 is a side view of a hat with portions thereof broken away to show a lighting device attached therein, in accordance with the present invention.

Turning to the drawings, in which like reference characters indicate corresponding elements throughout the several views, attention is first directed to FIG. 1, which illustrates a cap, hat, or the like, herein designated hat 10, having a lighting device 12 attached thereto. Lighting device 12 is constructed and positioned in accordance with the present invention so that a main body 14 is conveniently located inside hat 10 with a hat engaging portion 16 extending outside hat 10 and fixedly attaching device 12 to hat 10.

Figure 2:
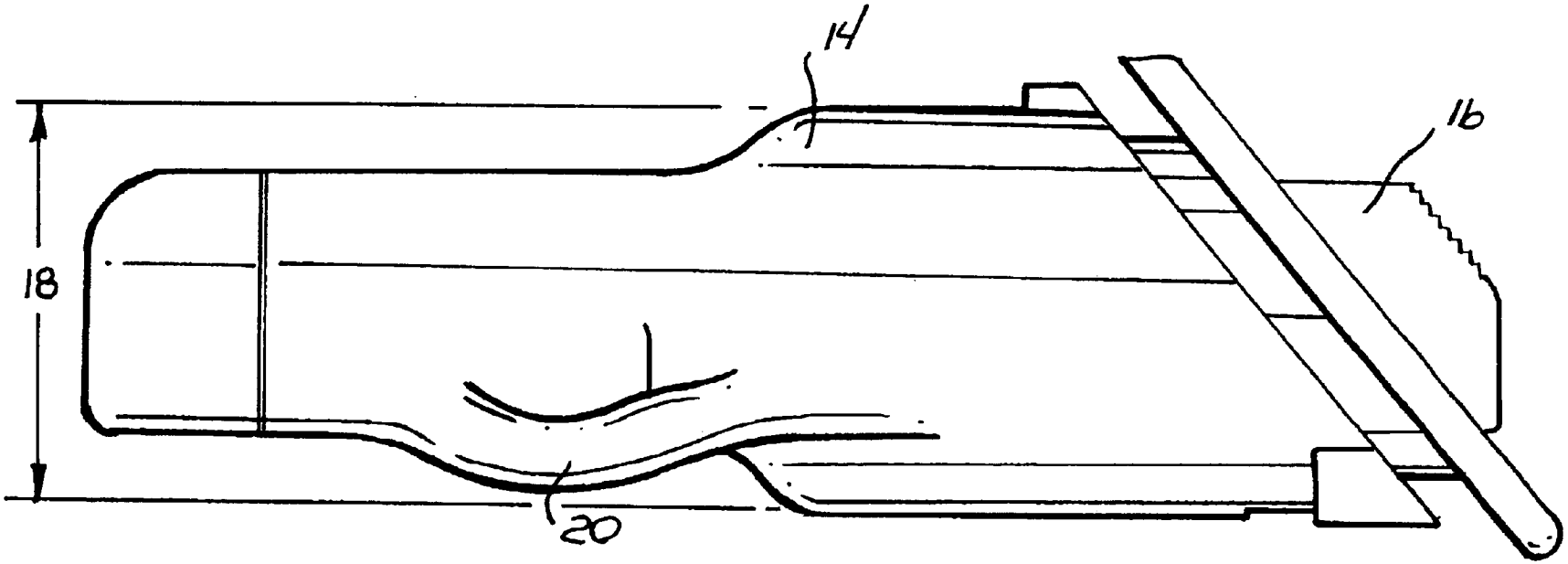
FIG. 2 is an enlarged side view of the lighting device of FIG. 1.
Figure 3:
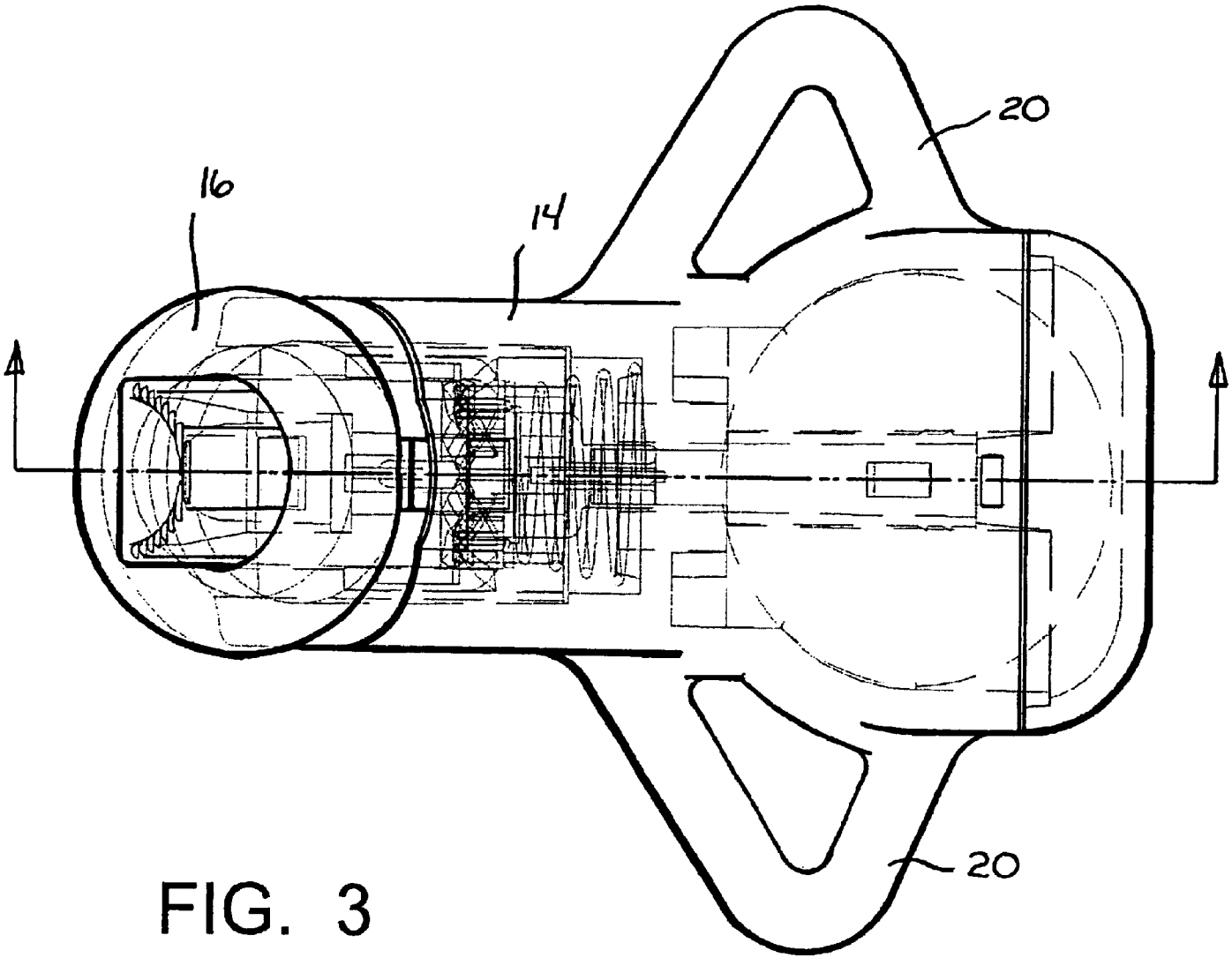
FIG. 3 is an enlarged top view of the lighting device of FIG. 1.

Referring additionally to FIGS. 2 and 3, it can be seen that body 14 of device 12 is constructed with a relatively small width so as to require only a small amount of the space within hat 10. In the preferred embodiment the width of body 14, designated 18 in FIG. 2, is in a range of approximately 0.5 inches to one inch. Device 12 is positioned with at least a portion of the lower surface lying against the top of the head of a person wearing hat 10. Generally, because of the small width device 12 will take less room than the person's hair so that its presence is practically un-noticeable.

As illustrated best in FIG. 3, body 14 is constructed with transversely extending projections or ears 20 that bear against the top of the wearer's head and stabilize device 12 to substantially prevent lateral or twisting movements. Additionally, ears 20 spread what little pressure is generated on an individual's head, further reducing any adverse effects. In this preferred embodiment, the overall length of device 12 is in a range of approximately 1.5 inches to 3 inches and the transverse dimension of ears 20 is in a range of 1.5 inches to 3 inches. While ears 20 are illustrated as loops of material integrally formed with body 14 and designed with an open configuration for maximum comfort, it will be understood that many other types and shapes of stabilizing devices might be incorporated if desired. Also while ears 20 are designed to engage the head of a wearer to reduce lateral and or rotary movement, it will be understood that some additional or alternative connection to hat 10 could be provided if desired.

Figure 4:
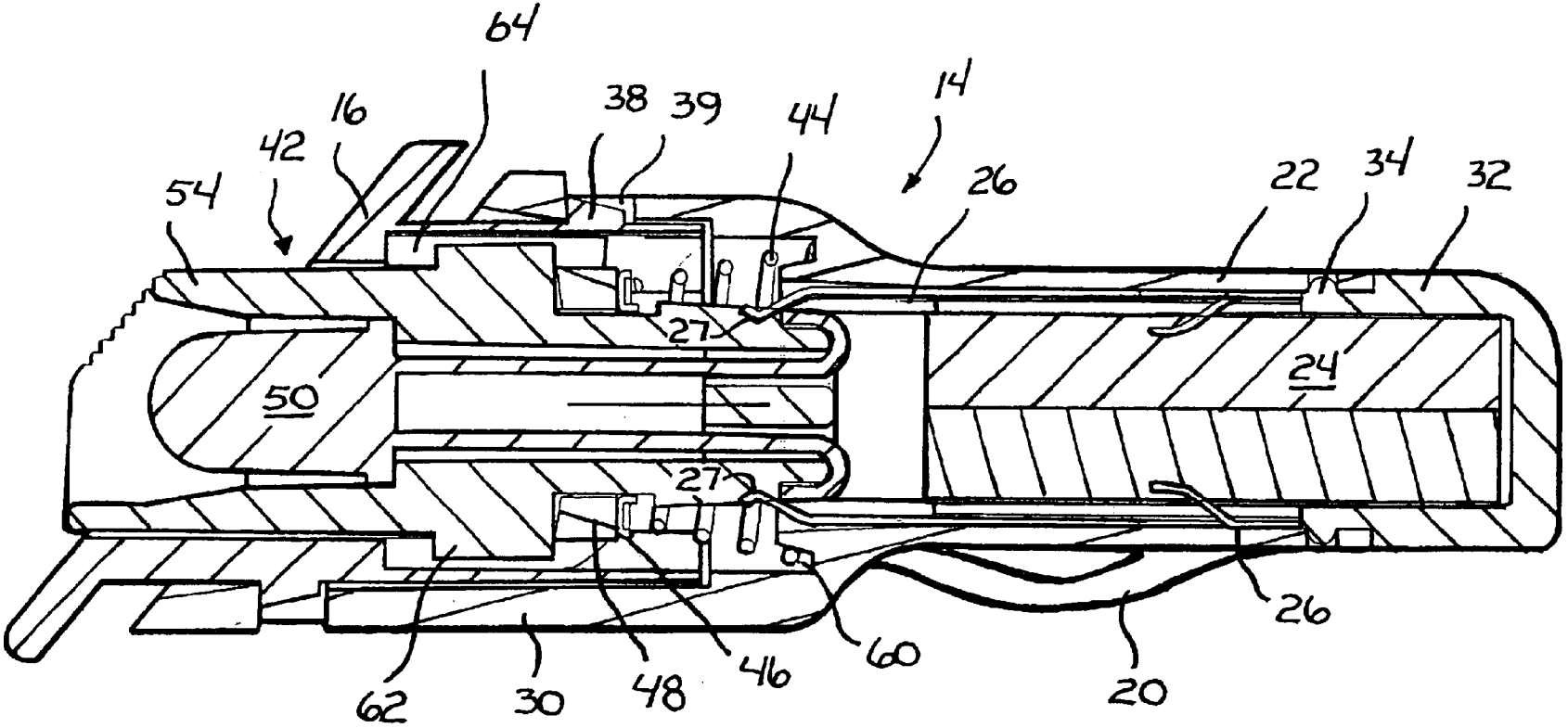
FIG. 4 is a sectional view of the lighting device as seen from the line 4—4 of FIG. 3.
Figure 5:
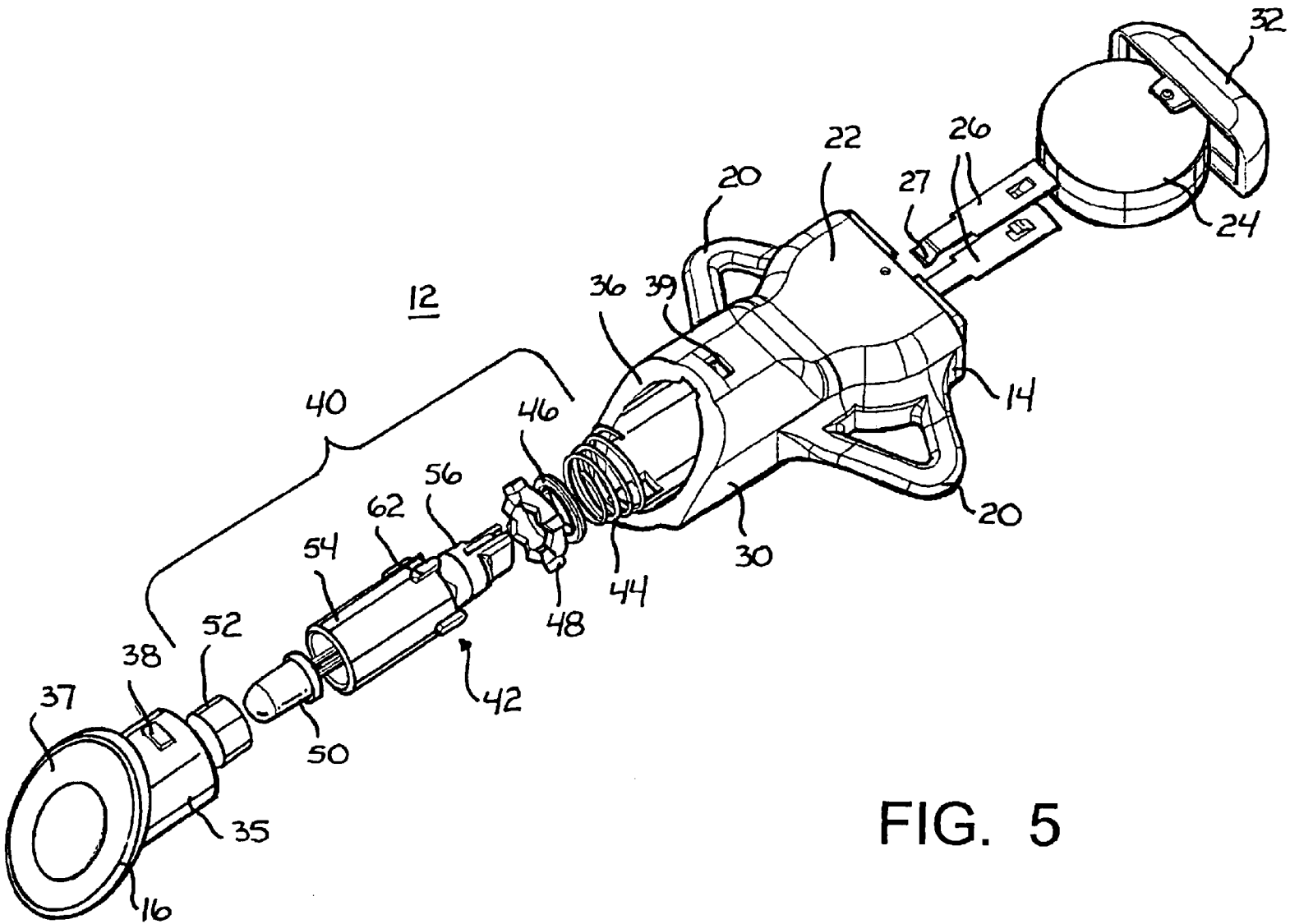
FIG. 5 is an exploded view in perspective of the lighting device of FIG. 1 illustrating the various components.

Turning now to FIGS. 4 and 5, the specific construction of this preferred embodiment of device 12 is illustrated. Body 14 includes a generally flat rear portion 22 with an interior cavity designed to receive one or more flat, circularly shaped batteries, designated battery 24. A pair of electrical connectors 26 are positioned in the upper and lower interior surfaces, respectively, of portion 22 so as to make an electrical connection with opposite terminals of battery 24. Connectors 26 each have an electrical contact 27 at a forward end that extends into a tubularly shaped front portion 30.

An end cap 32 is designed to mate with portion 22 and close the cavity so as to cooperate with the shape of the cavity in portion 22 and hold battery 24 fixedly in place. In this embodiment end cap 32 has a detent 34 that engages a small hole in portion 22 to maintain end cap 32 fixedly in place once it is engaged. End cap 32 is easily removed to remove and replace battery 24 by simply depressing detent 34 and disengaging end cap 32 from portion 22.

Tubularly shaped front portion 30 has a front end 36 angularly directed to substantially match the angle of the front portion or wall of the body of hat 10 when it is correctly positioned on the head of a wearer (see FIG. 1). End 36 is slanted or angled so that when device 12 is properly engaged in hat 10, body 14 slants generally rearwardly and upwardly along the interior of the body of hat 10 to provide maximum comfort and to utilize minimum space within hat 10. In a more specific description of the positioning of device 12, end 36 may be oriented in a range from in an approximately vertical plane to approximately 30 degrees from the vertical, depending upon the construction of hat 10 and the manner of wearing the hat. Thus, body 14 of device 12 is slanted rearwardly and upwardly at and angle to the horizontal in a range from approximately 45 degrees to approximately 90 degrees.

Hat engaging portion 16 includes an elongated rearwardly extending tubular portion 35 designed to slide coaxially into the opening defined by tubular portion 30 of body 14. Hat engaging portion 16 also includes an enlarged angled front end portion 37 that is positioned parallel and in spaced relation to front end 36 of tubular potion 30 when hat engaging portion 16 is properly engaged in tubular portion 30. To affix device 12 into hat 10, a hole is provided, or otherwise formed, in the front of the body of hat 10 generally spaced from the brim. Body 14 is positioned within hat 10 with front end 36 adjacent the hole. Hat engaging portion 16 is inserted into the hole and into the opening defined by tubular portion 30 of body 14 until detents 38 on tubular portion 35 engage openings 39 in tubular portion 30. With hat engaging portion 16 fixedly engaged in body 14, front end 36 and enlarged angled front end portion 37 are parallel and spaced apart sufficiently to pinch the body of hat 10 therebetween and hold device 12 fixedly positioned within hat 10.

A light and lens assembly 40 includes a housing 42, a helical compression spring 44, a front annular spring seat 46, an annular locking collar 48, an LED (light emitting diode) 50, and a lens 52. Here it should be noted that an LED is used in the preferred embodiment as the light source because they are very efficient to operate providing long battery life, do not produce excessive heat, and are extremely bright, compared to a common electric bulb. Also, different colors can be provided if desired.

Housing 42 is constructed with a front tubular portion 54 and a rear contact portion 56. As can best be seen in FIG. 4, LED 50 is inserted into the front of a central opening in tubular portion 54 of housing 42 until it bears against a radially inwardly directed shoulder in housing 42. The leads of LED 50 are inserted through axially extending holes in rear contact portion 56 and are bent around and outwardly to form electrical contacts on the rear outer surface of contact portion 56. Lens 52 is engaged in the front end of housing 42 and holds LED 50 firmly in place, as well as receiving light from LED 50 and directing the light forward and downward. In the embodiment illustrated in FIG. 4, tubular portion 54 is constructed with an upper stepped portion that is easily engaged by an operators finger, for depressing thereof to move rear contact portion into an out of engagement with electrical contacts 27. Depending upon the hat, type of brim, etc., light may be directed slightly outwardly to miss the brim or aimed as desired by various lenses and positioning. Here it should be noted that lens 52 can have any of a large variety of configurations designed to direct light from LED 50 into any desired direction, or possibly omitted, as desired.

In the positioning and operation of light and lens assembly 40, the rear end of spring 44 is positioned and held in an axially directed annular groove 60 formed in the inner surface of tubular portion 30 adjacent the rear end. Annular locking collar 48 is coaxially positioned over rear contact portion 56 of housing 42 and includes a forwardly directed toothed surface designed to engage a rearwardly directed toothed surface of housing 42. Front annular spring seat 46 is positioned over rear contact portion 56 so as to bear against the rear surface of locking collar 48. The front end of spring 44 is positioned in annular spring seat 46 and the entire light and lens assembly 40 is inserted into the front end of tubular portion 30 of body 14. Hat engaging portion 16 is then engaged in body 14, as described above, to hold light and lens assembly 40 in place.

With light and lens assembly 40 in place and hat engaging portion 16 fixedly engaged, radially outwardly directed stops 62 on the outer surface of tubular portion 54 of housing 42 are positioned in an annular groove 64 in the inner surface of the opening formed in tubular portion 30 of body 14. The front end of annular groove 64 is formed by a rear surface of hat engaging portion 16 so that axial movement of housing 42 is limited in the fully assembled orientation but can be removed for assembly, repairs, etc. when hat engaging portion 16 is disengaged from body 14.

The leads of LED 50 are positioned to make electrical contact with contacts 27 of connectors 26 when housing 42 is in a first orientation and to break electrical contact with contacts 27 in a second orientation. Housing 42 is moved between the first and the second orientations by pushing inwardly on tubular portion 54 and twisting housing 42 slightly in a clockwise or counter-clockwise direction. Here it will be understood that a variety of electrical switching structures can be devised and the described structure is preferred because of its simplicity and fail safe operation.

In a preferred embodiment, the various components described above, e.g. body 14, hat engaging portion 16, and housing 42, are formed of a light hard plastic which can be conveniently formed as, for example by molding or the like. Further, lens 52 can be made of plastic so that the various components are relatively inexpensive to manufacture and are safe and reliable.

Thus, a new and improved lighting device for hats and the like is disclosed that provides substantially brighter light. The new and improved lighting device for hats and the like fits more comfortably in a hat and substantially remains directed in a desired direction. Further, it is lighter, more convenient, and safe to wear and operate and is simpler and less expensive to manufacture.

The invention has been described above with reference to a preferred embodiment. However, those skilled in the art will recognize that changes and modifications may be made in the described embodiments without departing from the nature and scope of the invention. For instance, the shape or design of the body and the manner of switching the device on and off can be changed to any desired configuration Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

What is claimed is:

1. A hat light comprising:

an elongated body including stabilizers extending laterally outwardly to substantially reduce rotary movement;

a hat engaging member constructed to engage the elongated body and fixedly engage a front portion of a hat and to hold the elongated body oriented in an upward and backward direction within the hat from the engaged portion of the hat; and a light emitting diode mounted in the elongated body and positioned to direct light generated by the light emitting diode in a forward direction from the front portion of the hat.

2. A hat light as claimed in claim 1 wherein the member constructed to engage the elongated body is constructed to hold the elongated body oriented in an upward and backward direction lying in a range between an angle of 45 degrees to horizontal and 90 degrees to horizontal.

3. A hat light as claimed in claim 1 wherein the stabilizers include laterally extending ears included as an integral part of the body.

4. A hat light as claimed in claim 3 wherein the ears and a bottom surface of the body are designed to rest on the head of a wearer.

5. A hat light as claimed in claim 3 wherein the body and the ears are molded from plastic.

6. A hat light as claimed in claim 1 including a lens positioned adjacent the light emitting diode and formed to direct light generated by the light emitting diode outward and downward.

7. A hat light as claimed in claim 1 wherein the elongated body has a length in a range of approximately 1.5 inches to 3 inches.

8. A hat light as claimed in claim 1 wherein the elongated body has a width in a range of approximately 0.5 inches 1 inch.

9. A hat light as claimed in claim 1 wherein the elongated body has a transverse dimension in a range of approximately 1.5 inches to 3 inches.

10. A hat light comprising:

a hat having a body and defining a hole in a front portion of the body;

an elongated body including integral stabilizers extending laterally outwardly and positioned to engage the head of a wearer to substantially reduce rotary movement, the elongated body being positioned within the hat and with one end adjacent the hole;

a hat engaging member constructed to extend through the hole in the body of the hat and engage the one end of the elongated body and fixedly engage the front portion of the hat between the hat engaging member and the one end of the elongated body to hold the elongated body oriented in an upward and backward direction within the hat from the hole in the hat; and a light emitting diode mounted in the elongated body and positioned to direct light generated by the light emitting diode in a forward direction from the front portion of the hat.

11. A hat light as claimed in claim 10 wherein the member constructed to engage the elongated body is constructed to hold the elongated body oriented in an upward and backward direction lying in a range between an angle of 45 degrees to horizontal and 90 degrees to horizontal.

12. A hat light as claimed in claim 10 wherein the stabilizers include laterally extending ears included as an integral part of the body.

13. A hat light as claimed in claim 12 wherein the ears and a bottom surface of the body are designed to rest on the head of a wearer.

14. A hat light as claimed in claim 12 wherein the body and the ears are molded from plastic.

15. A hat light as claimed in claim 10 including a lens positioned adjacent the light emitting diode and formed to direct light generated by the light emitting diode outward and downward.

16. A hat light comprising:

a hat having a body and defining a hole in a front portion of the body;

an elongated tubular body including integral stabilizing ears extending laterally outwardly and positioned to engage the head of a wearer to substantially reduce rotary movement, the elongated tubular body including an axially extending opening with a forward end of the opening defined by a forward end of the elongated tubular body, and the tubular body being positioned within the hat and with the forward end of the opening adjacent the hole;

a hat engaging member constructed to extend through the hole in the body of the hat and into the forward end of the opening in the elongated body to engage the elongated body and fixedly grip the front portion of the hat between the hat engaging member and the forward end of the elongated body, the hat engaging member and the forward end of the elongated body being formed to hold the elongated body oriented in an upward and backward direction within the hat generally along a wearer's head; and a light emitting diode mounted in the axial opening in the elongated body and positioned to direct light generated by the light emitting diode in a forward direction from the front portion of the hat.

17. A hat light as claimed in claim 16 wherein the hat engaging member and the forward end of the elongated body are constructed to hold the elongated body oriented in an upward and backward direction lying in a range between an angle of 45 degrees to horizontal and 90 degrees to horizontal.

* * * * *